US007029298B2

(12) United States Patent
Jiang

(10) Patent No.: US 7,029,298 B2
(45) Date of Patent: Apr. 18, 2006

(54) CARD EDGE CONNECTOR

(75) Inventor: Jong-Shiun Jiang, Taipei Hsien (TW)

(73) Assignee: Starlink Electronics Corp., Taipei Hsien (TW)

( * ) Notice: Subject to any disclaimer, the term of this patent is extended or adjusted under 35 U.S.C. 154(b) by 0 days.

(21) Appl. No.: 10/958,292

(22) Filed: Oct. 6, 2004

(65) Prior Publication Data

US 2006/0035493 A1 Feb. 16, 2006

(30) Foreign Application Priority Data

Aug. 11, 2004 (TW) ..... 93212761 U

(51) Int. Cl.
*H01R 13/62* (2006.01)

(52) U.S. Cl. ..... 439/157

(58) Field of Classification Search ..... 439/157, 439/160, 154, 159

See application file for complete search history.

(56) References Cited

U.S. PATENT DOCUMENTS 5,470,242 A * 11/1995 Cheng et al. ..... 439/157
5,662,485 A * 9/1997 Yip et al. ..... 439/157

* cited by examiner

*Primary Examiner*—Phuong Dinh
(74) *Attorney, Agent, or Firm*—Leong C. Lei

(57) ABSTRACT

A card edge connector is provided. The card edge connector includes a positioning base and a latch member pivotally connected to the positioning base. A positioning groove is formed on the outer sides of the positioning base, while at least an elastic locking arm is formed on one side of the bulky body. In addition, a hook portion is formed on the elastic locking arm. By pressing the latch member, one can clearly feel or sense the locking or releasing of the hook portion of the elastic locking arm from the positioning groove.

1 Claim, 8 Drawing Sheets

CARD EDGE CONNECTOR

This Nonprovisional application claims priority under 35 U.S.C. § 119(a) on Patent Application No(s). 093212761 filed in Taiwan, Republic of China on Aug. 11, 2004, the entire contents of which are hereby incorporated by reference.

BACKGROUND OF THE INVENTION

1. Field of Invention

The present invention relates generally to an obtruding device of card edge connector, and more particularly to an obtruding device that provides a precise locking position for easing the assembly of the connector onto a printed circuit board to prevent faulty operations.

2. Prior Art

Card edge connectors are widely used in a large variety of electronic devices. For example, one can often see applications of card edge connectors in communication, computer and computer peripheral devices. The card edge connectors are primarily disposed on a computer motherboard, so as to allow the golden fingers at the board rim of smaller circuit boards to vertically plug therein. Referring to FIG. 7, the insertion connection of a card edge connector body 40 and a printed circuit board 60 is illustrated. Referring again to FIG. 7 and to FIG. 8, there is illustrated a blocking pillar 41 having a long groove 42 being disposed on one side of the connector body 40. The outer most side of the connector body 40 comprises an assembly groove 43 inwardly formed thereon. A latch member 50 having a pivot 53 is pivotally disposed in the assembly groove 43. A compressive portion 51 is formed on the upper portion of the latch member 50, while an obtruding portion 52 is protrusively formed at the lower portion of the latch member 50. The obtruding portion 52 is inserted into the insertion groove 44 of the connector from the long groove 42 of the blocking pillar 41. When one wants to take away the printed circuit board 60 from the insertion groove 44, the compressive portion 51 of the latch member 50 is pressed outward. This inwardly levers up the obtruding portion 52 through the pivot 53 of the latch member 50, thereby pushing the bottom rim 61 of the printed circuit board 60 upward. The printed circuit board 60 is thus pushed off from the insertion groove 44.

However, such conventional card edge connectors are disadvantageous in that the latch member 50 does not comprise any positioning structure, neither any step mechanism. Therefore, when inserting the printed circuit board 60 into the connector by applying a force P2 thereon, it is likely that the printed circuit board 60 is not completed inserted in position. On the other hand, since there is nowhere to know whether the printed circuit board 60 is properly inserted to the conventional connector, one can easily apply an excessive amount of force P2 to the insertion groove 44 of the connector, which can easily damage the contacts on the connector.

SUMMARY OF THE INVENTION

Therefore, one objective of the present invention is to provide a card edge connector that can render clear information of proper insertion or removal of a printed circuit board on the connector. In this manner, the assembly of the printed circuit board takes less time, while faulty operations are prevented from happening.

DETAILED DESCRIPTION OF THE PREFERED EMBODIMENTS

In order to better understanding the novel features of the present invention, it is hereinafter described in detail by incorporating with the accompanying drawings.

Figure 1:
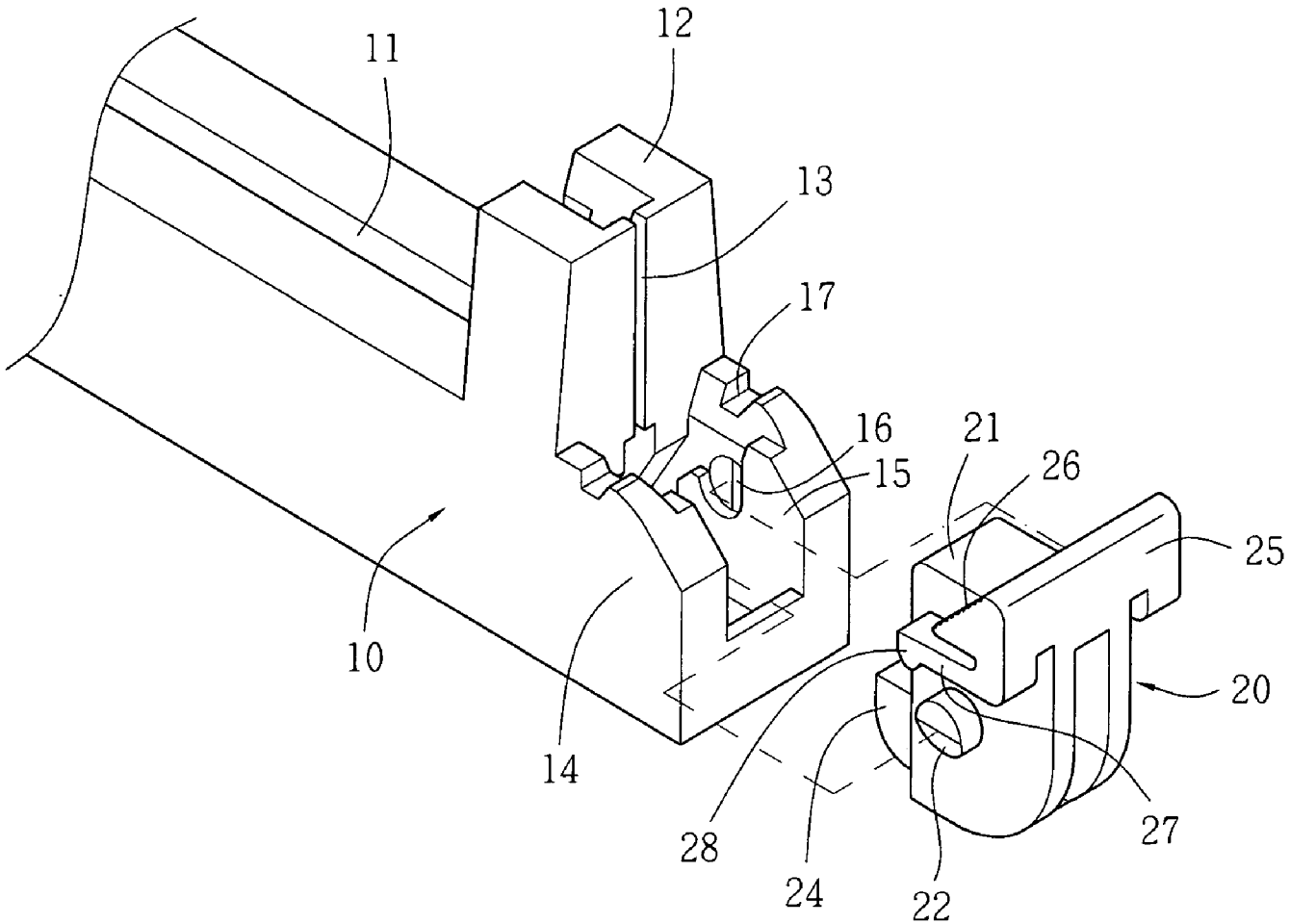
FIG. 1 is a perspective view of a card edge connector of the present invention.
Figure 6:
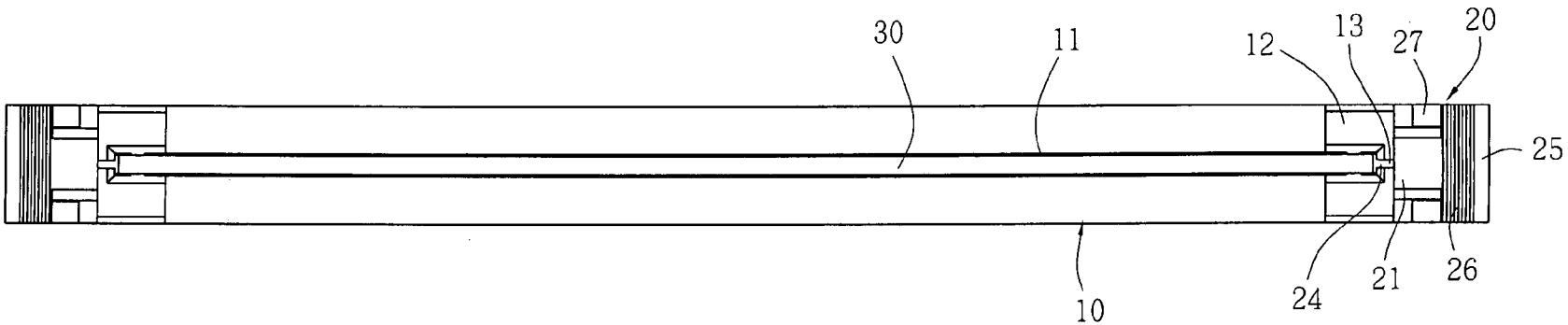
FIG. 6 is a top elevation of the card edge connector of the present invention.
Figure 7:
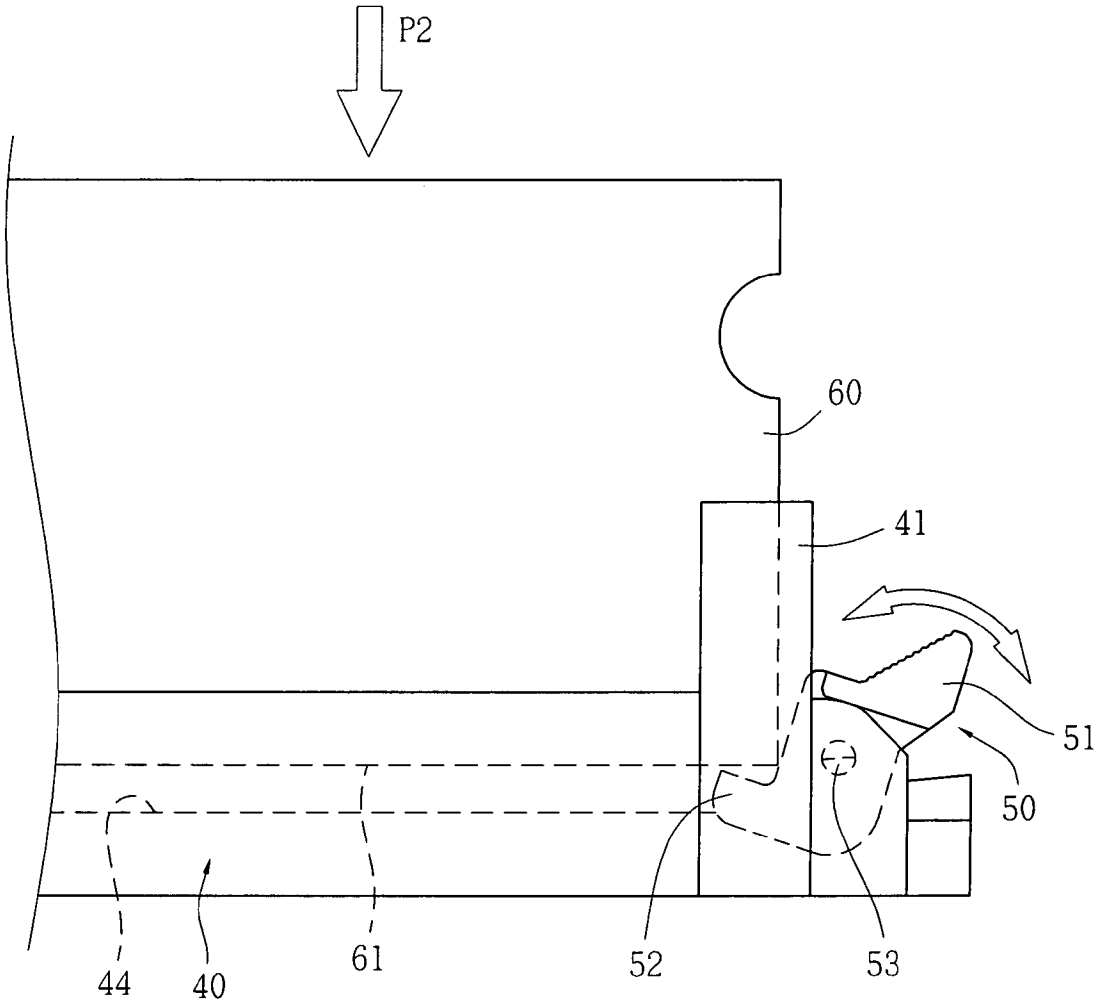
FIG.7 (PRIOR ART)
FIG. 7 is a side elevation of a conventional card edge connector.
Figure 8:
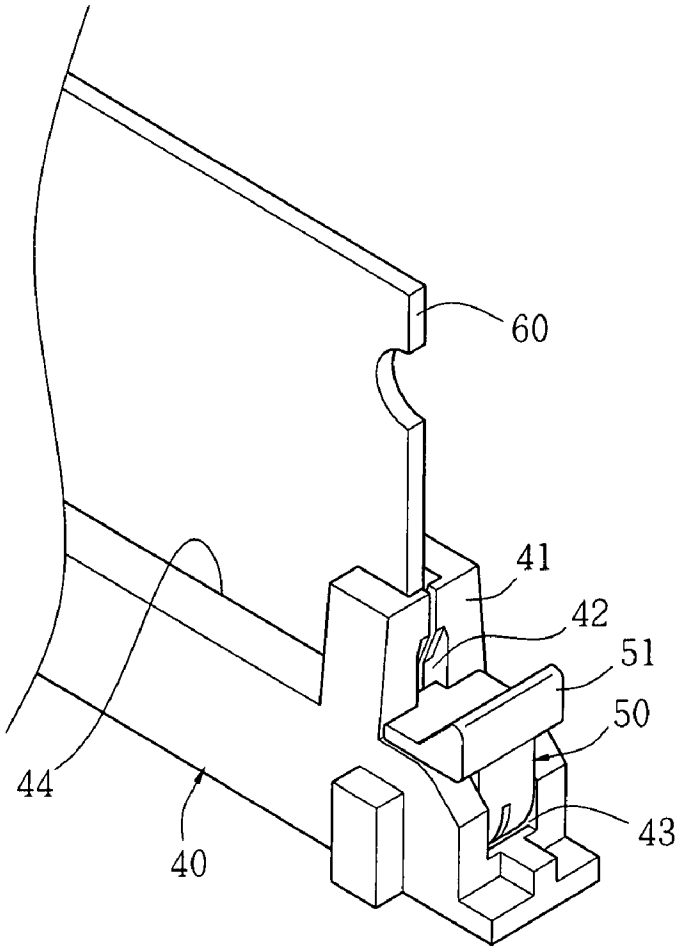
FIG.8 (PRIOR ART)
FIG. 8 is a perspective view of the conventional card edge connector.

Referring to FIG. 1 and FIG. 6, the card edge connector of the present invention comprises a connector body 10 and a latch member 20 disposed on each of the two ends of the connector body 10. A blocking pillar 12 having a long groove 13 is formed on each of the two ends of the insertion groove 11 of the connector body 10. A positioning base 14 having an assembly groove 15 is formed outside of the blocking pillar 12. A pivotal hole 16 is formed on two sides of the assembly groove 15, so as to pivotally connect the pivot 22 of the latch member 20 thereon. Moreover, a positioning groove 17 is formed on the peripheral top portion of the positioning base 14.

Figure 2:
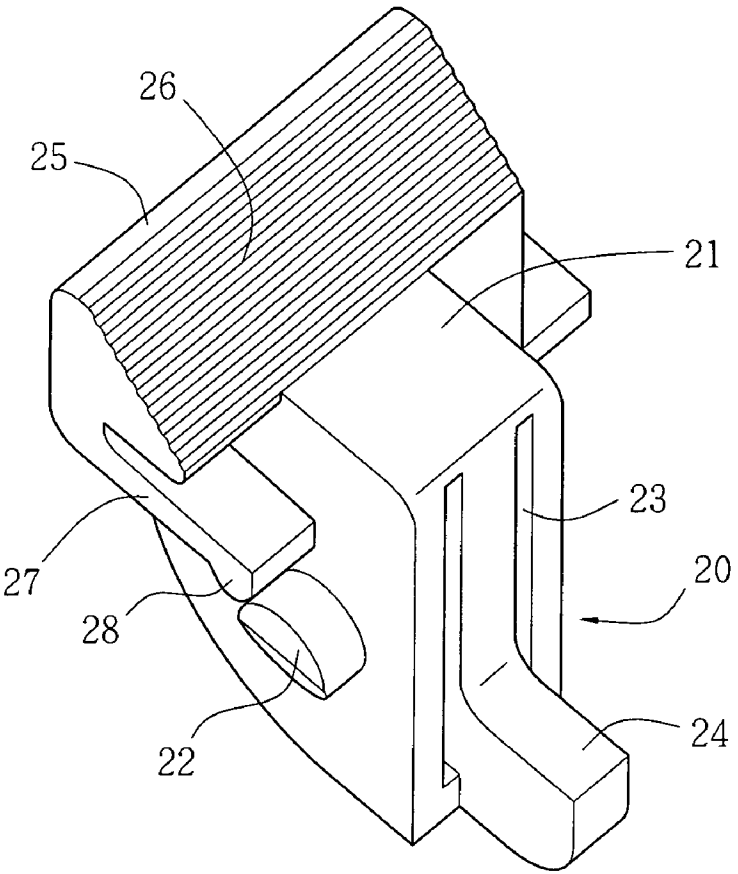
FIG. 2 is a perspective view of a latch member of the card edge connector of the present invention.
Figure 3:
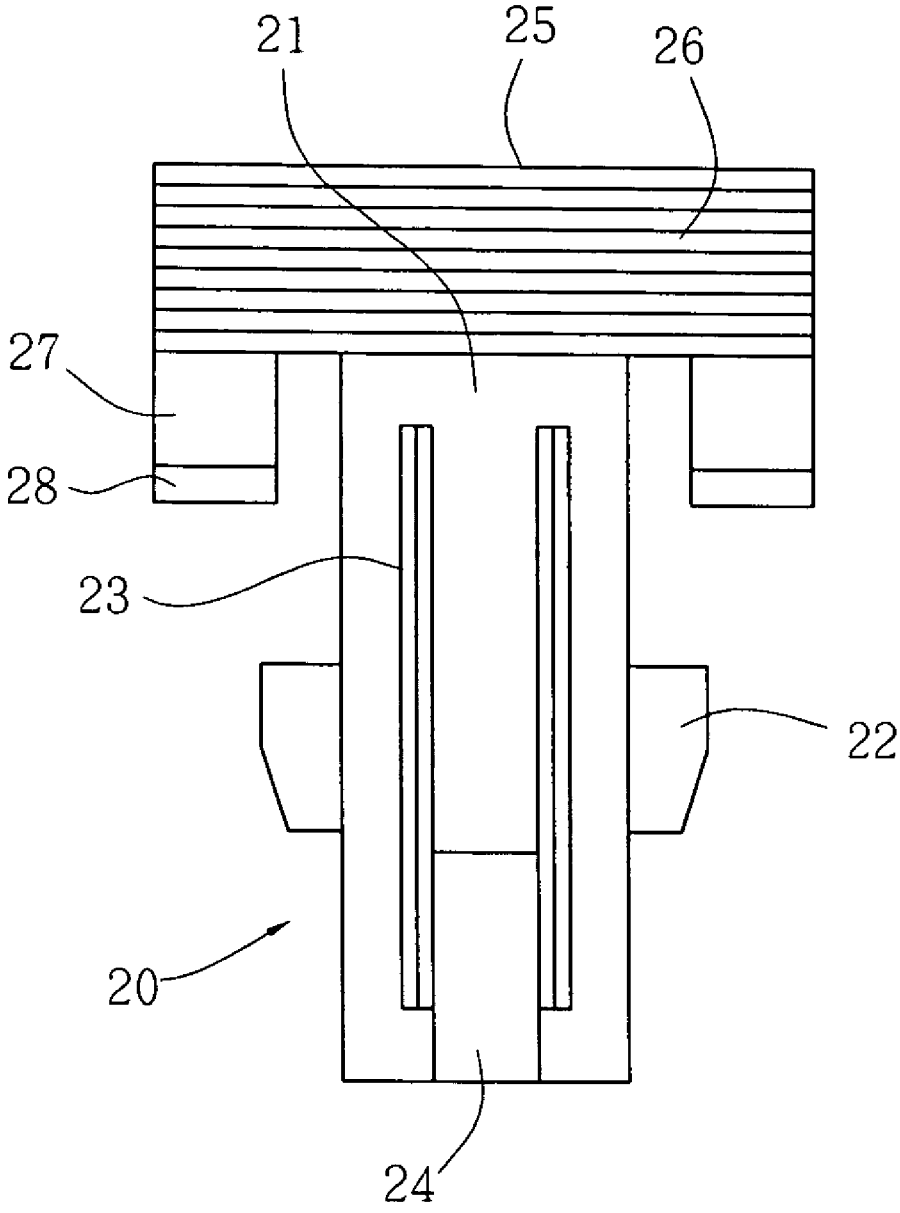
FIG. 3 is a front elevation of the latch member of the card edge connector of the present invention.

Referring to FIG. 1, FIG. 2 and FIG. 3, the latch member 20 comprises a bulky body 21, and a pivot 22 on two sides of the bulky body 21. An obtruding portion 24 is protrusively formed on the bottom portion of the latch member 20. A compressive portion 25 having a inclined surface is formed on the top portion of the bulky body 21, while a plurality of non-slippery carvings 26 is formed on the compressive portion 25. The latch member 20 comprises an elastic locking arm 27 horizontally formed on two sides of the bulky body 21. A hook portion 28 is formed at one end of the elastic locking arm 27. When assembly the latch member 20 to the assembly groove 15 of the connector, the hook portion 28 of the elastic locking arm 27 is elastically locked in the positioning groove 17 at the top portion of the positioning base 14.

The bulky body 21 of the latch member 20 further comprises a plurality of gaps 23 formed thereon. In this particular embodiment, the gaps 23 are formed in parallel behind the two pivots 22 of the bulky body 21. In this manner, the pivots 22 become elastically compressible, which renders the assembly of the latch member 20 on the connector body 10 much easier. Furthermore, the gaps 23 as shown in FIG. 1 can be extended to form hollow gaps so as to reduce weight and the use of material.

Figure 4:
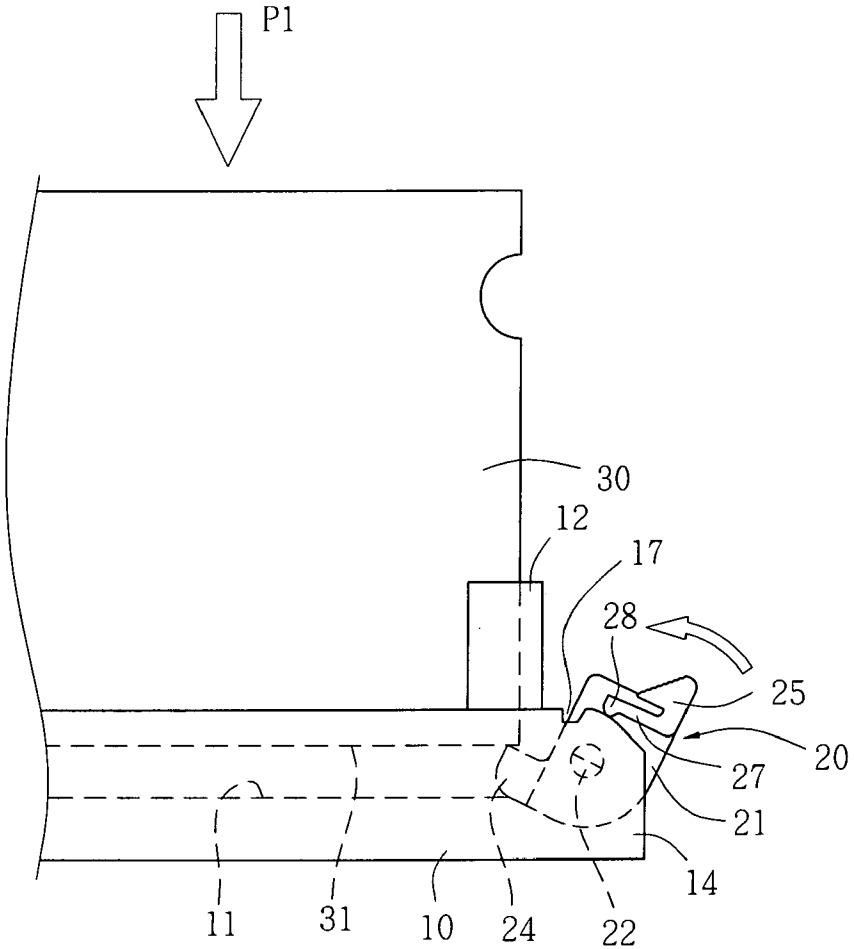
FIG. 4 illustrates a printed circuit board not yet inserted in the card edge connector of the present invention.
Figure 5:
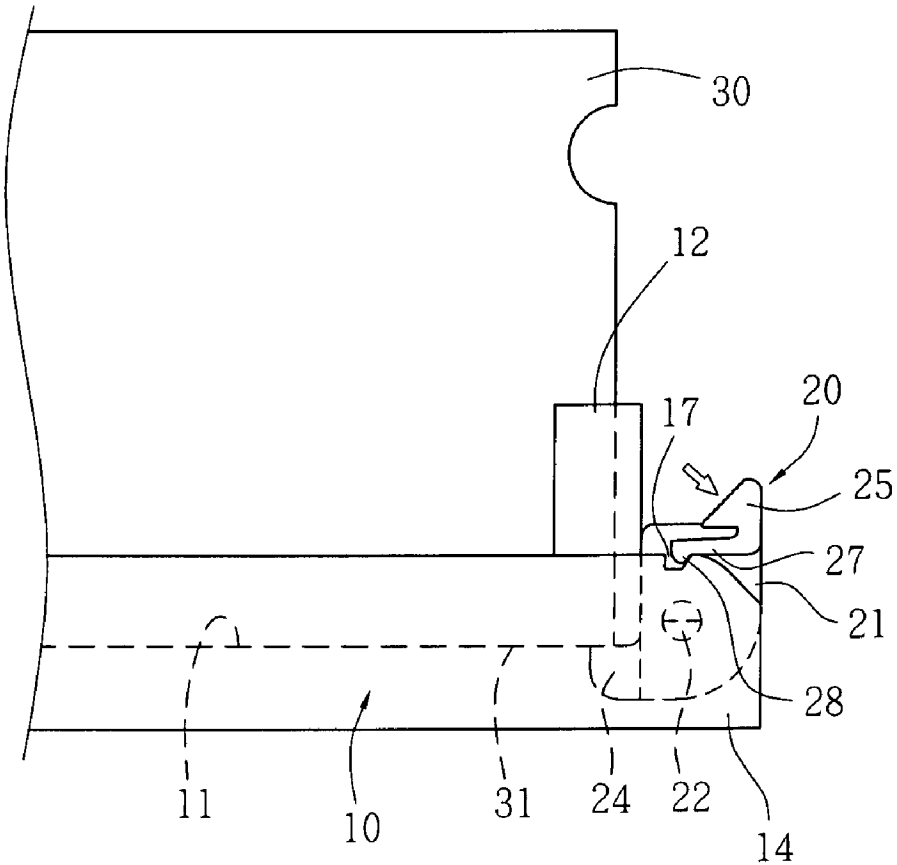
FIG. 5 illustrates a printed circuit board being inserted in the card edge connector of the present invention.

Referring to FIG. 4, FIG. 5 and FIG. 6, the latch member 20 is pivotally connected to the assembly groove 15 of the connector body 10 through the pivots 22. The obtruding portion 24 is inserted into the insertion groove 11 from the long groove 13 of the blocking pillar 12. As shown in FIG. 4, when applying a force (P1) to a printed circuit board 30 for inserting the printed circuit board 30 into the insertion groove 11, the bottom rim 31 of the printed circuit board 30 presses the obtruding portion 24 to inwardly rotate the latch member 20. When the printed circuit board 30 is inserted in position, the hook portion 28 of the elastic locking arm 27 of the latch member 20 locks in the positioning groove 17 at the top portion of the positioning base 14. At the same time, a clicking sound is produced. One can also feels the click when inserting the printed circuit board 30 by hand. The printed circuit board 30 is thus securely inserted in position. On the other hand, when one wants to remove the printed circuit board 30 from the insertion groove 11, the compressive portion 25 is pressed to rotate the latch member 20. As shown in FIG. 5, rotating the latch member 20 pushes the obtruding portion 24 upward to apply a force on the bottom rim 31 of the printed circuit board 30. The hook portion 28 of the elastic locking arm 27 is thus released from the positioning groove 17 of the positioning base 14. One can clearly feel that the force applied on the compressive portion 25 becomes smaller. Meanwhile, the printed circuit board 30 is properly removed from the insertion groove 11.

The card edge connector of the present invention is advantageous in that:

1. The latch member comprises the elastic locking arm having the hook portion formed thereon, while the connector body comprises the locking groove formed thereon. One can thus clearly feel or sense whether the printed circuit board is properly inserted or removed. Therefore, the card edge connector of the present invention can reduce the time required for assembly and prevent faulty operations or damages from happening.
2. The latch member comprises two gaps formed behind the two pivots of the bulky body. The pivots thus become elastically compressible, which renders the assembly of the latch member to the connector body much easier. In addition, the gaps can be extended to form hollow gaps so as to reduce weight and the use of material.

Since, any person having ordinary skill in the art may readily find various equivalent alterations or modifications in light of the features as disclosed above, it is appreciated that the scope of the present invention is defined in the following claims. Therefore, all such equivalent alterations or modifications without departing from the subject matter as set forth in the following claims is considered within the spirit and scope of the present invention.

What is claimed is:

1. A card edge connector comprising:

a connector body having an insertion groove which is open at a top of said connector body, a blocking pillar formed on each of two ends of said insertion groove, a positioning base formed outside of said blocking pillar and having an assembly groove, a pivotal hole being formed two sides of said assembly groove, and a positioning groove formed on a top of said positioning base; and a latch member having a bulky body, a pivot on two sides of said bulky body and adapted to engage with said pivotal hole, an obtruding portion protrusively formed on a bottom portion of said latch member, a compressive portion being formed on a top portion of said bulky body and having an inclined surface having a plurality of non-slippery carvings, an elastic locking arm horizontally formed on two sides of said bulky body and adapted to engage with said positioning groove, a hook portion being formed at one end of said elastic locking arm, said bulky body being formed with two parallel gaps each at one side of said obtruding portion thereby making said pivots elastically compressible, said latch member whereby when a printed circuit board is inserted into said positioning groove and depressed downwardly, a bottom rim of said printed circuit board will force said obtruding portion to rotate said latch member inwardly said inclined surface of said latch member is depressed, and when said printed circuit board is inserted in position, said hook portion of said elastic locking arm of said latch member will engage with said positioning groove thereby generating a clicking sound and informing a user that said printed circuit board is properly connected with said connector.

* * * * *